US007192157B2

(12) United States Patent
Sloan et al.

(10) Patent No.: US 7,192,157 B2
(45) Date of Patent: Mar. 20, 2007

(54) METHOD FOR FABRICATING A BENT PERIMETER LIGHT

(75) Inventors: Thomas C. Sloan, Santa Barbara, CA (US); Bruce Quaal, Ventura, CA (US)

(73) Assignee: SloanLED, Inc., Ventura, CA (US)

( * ) Notice: Subject to any disclaimer, the term of this patent is extended or adjusted under 35 U.S.C. 154(b) by 0 days.

(21) Appl. No.: 11/286,113

(22) Filed: Nov. 23, 2005

(65) Prior Publication Data

US 2006/0133076 A1 Jun. 22, 2006

Related U.S. Application Data

(62) Division of application No. 10/676,997, filed on Sep. 30, 2003.

(60) Provisional application No. 60/414,991, filed on Oct. 1, 2002.

(51) Int. Cl.
*F21V 7/10* (2006.01)

(52) U.S. Cl. ..... 362/216; 362/235; 264/2.7; 264/295

(58) Field of Classification Search ..... 65/108, 65/102; 264/2.7, 285, 295; 362/216, 235
See application file for complete search history.

(56) References Cited

U.S. PATENT DOCUMENTS

| | | | | |
|---|---|---|---|---|
| 2,611,216 | A * | 9/1952 | Snow et al. | 65/110 |
| 4,439,818 | A | 3/1984 | Scheib | 362/250 |
| 4,521,839 | A | 6/1985 | Cook et al. | 362/238 |
| 4,712,165 | A | 12/1987 | Cetrone | 362/147 |
| 5,099,401 | A | 3/1992 | Kondo et al. | 362/541 |
| 5,559,681 | A | 9/1996 | Duarte | 362/252 |
| 6,186,645 | B1 | 2/2001 | Camarota | 362/249 |
| 6,283,612 | B1 | 9/2001 | Hunter | 362/240 |
| 6,406,166 | B1 | 6/2002 | Ko | 362/249 |
| 6,511,206 | B1 | 1/2003 | Wong | 362/250 |
| 6,609,813 | B1 | 8/2003 | Showers et al. | 362/240 |

FOREIGN PATENT DOCUMENTS

| | | |
|---|---|---|
| DE | 20117762 U | 4/2002 |
| DE | 20119861 U | 6/2002 |
| DE | 20203824 U | 7/2002 |

* cited by examiner

*Primary Examiner*—Sandra O'Shea
*Assistant Examiner*—Jason Moon Han
(74) *Attorney, Agent, or Firm*—Koppel, Patrick, Heybl & Dawson

(57) ABSTRACT

A method for bending a perimeter light and a perimeter light for illuminating curved surfaces. One embodiment of a bending method according to the present invention comprises heating a perimeter light to make it pliable. A radius tool is then provided having a curved surface with a shape and radius for the desired bend in the perimeter light. The heated perimeter light is mounted to the radius tool curved surface. The perimeter light is then cooled and removed from the radius tool.

18 Claims, 8 Drawing Sheets

METHOD FOR FABRICATING A BENT PERIMETER LIGHT

This divisional application claims the benefit of U.S. patent application Ser. No. 10/676,997 filed sep. 30, 2003 which claims the benefit of U.S. Provisional Patent Application Ser. No. 60/414,991 to Sloan et al. filed on Oct. 1, 2002.

BACKGROUND OF THE INVENTION

1. Field of the Invention

This invention relates to perimeter or border lighting and more particularly to perimeter or border lighting for curved surfaces using light emitting diodes as the light source.

2. Description of the Related Art

Perimeter or border lights ("perimeter lighting") are commonly used on buildings to accentuate the structure, to draw customer attention to the building, and to provide safety lighting. Most conventional perimeter lights use neon bulbs for the light source. Some of the disadvantages of neon lighting is that neon bulbs have a relatively short life, are fragile and can consume a relatively large amount of power. Also, neon bulbs can experience difficulty with cold starting, which can lead to the bulb's failure.

Advancements in light emitting diode ("LED") technology has resulted in devices that are brighter, more efficient and more reliable. LEDs are now being used in many different applications that were previously the realm of incandescent bulbs, some of which include displays, automobile taillights and traffic signals. As the efficiency of LEDs improve it is expected that they will be used in most lighting applications.

U.S. Pat. No. 4,439,818 to Scheib discloses a lighting strip that utilizes LEDs as the light source. The strip is flexible in three dimensions and is useful in forming characters and is capable of providing uniform illumination regardless of the characters selected for display. The strip comprises a flexible multi-layered pressure sensitive adhesive tape that has a plurality of triangle cutout sections on each side of the tape to allow the tape to bend. LEDs are connected in a series with a resister along the tape. One disadvantage of this strip is that it cannot be cut to match the different lengths of a particular feature to be illuminated, and still be connected in a series with other LED strips. Light from the LEDs is also not diffused so the tape does not give the appearance of neon light. This arrangement is also not durable enough to withstand the conditions for outdoor use because the flexible tape and its adhesive can easily deteriorate when continually exposed to the elements.

U.S. Pat. No. 5,559,681 to Duarte, discloses a flexible, self adhesive, light emissive material that can be cut into at least two pieces. The light emissive material includes a plurality of electrically coupled light emissive devices such as light emitting diodes. The material also includes electric conductors for conducting electric power from the source of electric power to each of the light emissive devices. While this lighting arrangement is cuttable to different lengths, the light it emits is not dispersed to appear as a neon light source. This arrangement is also not durable enough to withstand the conditions for outdoor use.

PCT International Application Number PCT/AU98/00602 discloses perimeter light that uses LEDs as its light source and includes a light tube structure in which multiple LEDs are arranged within an elongated translucent tube that diffuses or disperses the light from the LEDs. The perimeter light is used to highlight or decorate one or more features of a structure, such as a roof edge, window, door or corner between a wall or roof section.

One of the disadvantages of this perimeter light is that it cannot be cut to match the length of a building's structural features. Instead, it must be custom ordered or it is mounted without fully covering the structural feature. Also, the connectors between adjacent sections of lighting are bulky and result in a visible junction between the sections. The light's tube significantly attenuates the light emitted by its LEDs, significantly reducing the light's brightness. Further, the light does not include a mechanism for compensating for the expansion and contraction between adjacent lights. There is also no apparatus or method for providing perimeter lighting that can be bent to match a curved structural feature of a building.

SUMMARY OF THE INVENTION

The present invention provides a method and system for bending perimeter lights to match curved surfaces, such as a curved feature of a structure. The present invention also provides a rugged bent perimeter light and perimeter lighting system wherein the perimeter lights can be cut in the field to match the structural features.

One method for bending a perimeter light according to the present invention comprises heating a perimeter light a first time to make it pliable. A radius tool is then provided having a curved surface with a shape and radius for the desired bend in the perimeter light. The heated perimeter light is mounted to the radius tool's curved surface. The perimeter light is then cooled and removed from the radius tool.

One embodiment of system for bending a perimeter light according to the present invention comprises a heater for heating a perimeter light to make it pliable and a radius tool having a curved surface. The radius tool further comprises a mechanism for holding the heated perimeter light to the curved surface while it cools.

One embodiment of a bent elongated perimeter light according to the present invention comprises an array of light sources that are illuminated by electric power and an elongated tube bent to match a curve or shape. The array of light sources is disposed within the tube with the tube transmitting and dispersing the light from the array allowing the tube to give the appearance that the array of light sources is a continuous light source. The array of light sources can be cut at intervals to shorten the array while allowing the remaining light sources in the array to emit light. The tube is also cuttable to match the length of the array.

One embodiment of a system for mounting perimeter lights to a body having straight and curved surfaces according to the present invention comprises a plurality of straight and bent elongated perimeter lights. Each of the perimeter lights comprises an array of light sources that are illuminated by electric power, an elongated transparent tube with the array of light sources disposed within the tube. The tube transmits and disperses the light from the array giving the appearance that the array of light sources is a continuous light source. The array of light sources can be cut at intervals to shorten the array while allowing the remaining light sources in the array to emit light. The tube can also be cut to match the length of the array. The system further comprises a longitudinal anchoring slot running along the tube. The plurality of perimeter lights are electrically coupled in a daisy-chain with the electrical power at each of the plurality of perimeter lights transmitted to the successive of the plurality of perimeter lights. A plurality of anchoring buttons are included that are mounted to the body in a line along the surfaces to be illuminated. The anchoring slot of each of said plurality of perimeter lights is mated to the anchoring buttons. Each of the plurality of straight perimeter lights is anchored to a straight portion of the body and each of the plurality of bent perimeter lights anchored to a curved portion of the body.

These and other further features and advantages of the invention will be apparent to those skilled in the art from the following detailed description, taken together with the accompanying drawings, in which:

DETAILED DESCRIPTION OF THE INVENTION

Method for Bending

Figure 1:
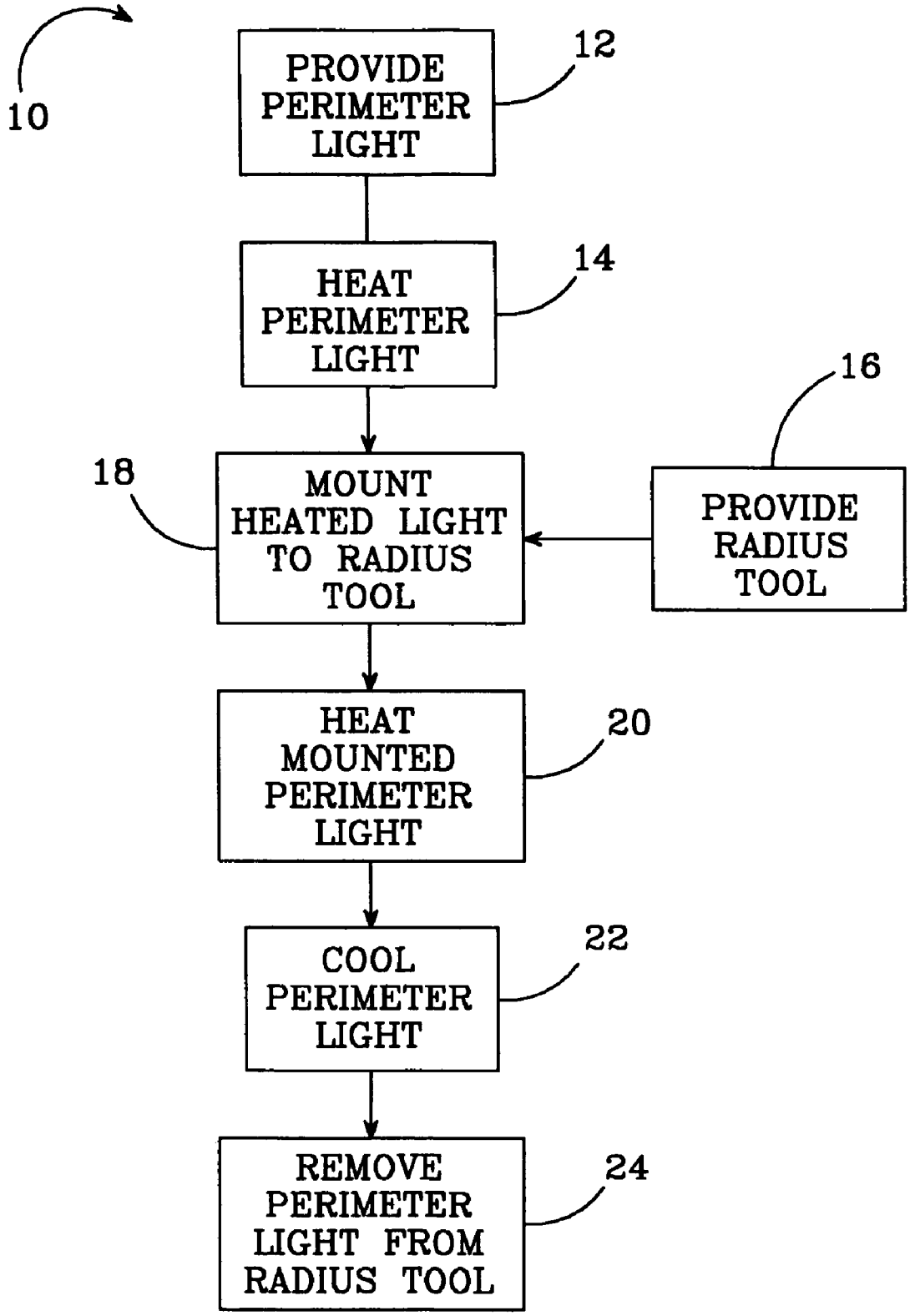
FIG. 1 is a flow diagram for one embodiment of a method for bending a perimeter light according to the present invention.
Figure 2:
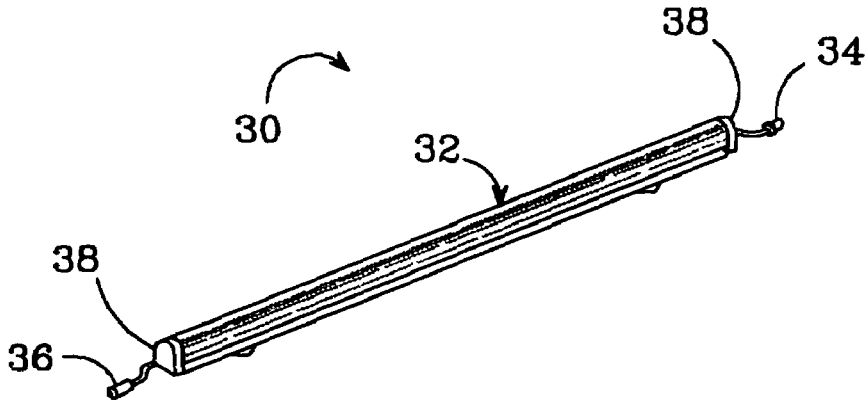
FIG. 2 is a perspective view of a straight section of LED perimeter lighting.

FIG. 1 shows a flow diagram for one embodiment of a method 10 for bending an otherwise straight perimeter light. In the first step 12, a perimeter light is provided and FIG. 2 shows one type of straight LED perimeter light 30 that can be provided in step 12 to be bent by method 10. The perimeter light 30 generally comprises a tube 32 with light emitting diodes arranged within the tube so that a bias can be applied to the LEDs causing them to emit light. In one embodiment of perimeter light 30, an internal printed circuit board (PCB) LED array runs the length of the tube 32, with LEDs mounted on or more PCBs such that they emit light when a bias is applied to the PCB(s). Male and female connectors 34 and 36 can also be included at opposing ends of the tube 32 so that sections of the perimeter light 30 can be daisy chained together. The tube 32 can also comprise end caps 38 to close off the open ends of the tube to prevent dirt and moisture from entering. The end caps can also serve as bumpers to compensate for expansion of adjacent lights.

The tube 32 should be made of a material that transmits light and is impact resistant and UV stable, with one of the preferred materials being acrylic. Acrylic generally cannot be bent when it is at room temperature and generally requires heating to allow it to bend.

In step 14, the perimeter light is heated to make it pliable. Many different heating methods can be used according to the invention, with the preferred method utilizing an environmental chamber that is large enough and can maintain a high enough temperature. One suitable environmental chamber is the commercially available model number T20C, provided by Tenney Engineering, Inc.

The perimeter light 30 is placed in the environment chamber to soak for a desired amount of time to achieve the desired level of pliability. The soak times can vary depending on the type of tube material, as well as its thickness, and the temperature of the environmental chamber. For a perimeter light having an acrylic tube that is 0.85 inches thick, a suitable temperature for the environmental chamber is approximately 95° C. A sufficient amount of time for the perimeter light to soak so that it becomes pliable is approximately 10 minutes. The perimeter light can be soaked with or without the LEDs mounted within the tube 32. In those embodiments where the perimeter light is bent without the LEDs, the LEDs are inserted after the bending process.

Figure 3:
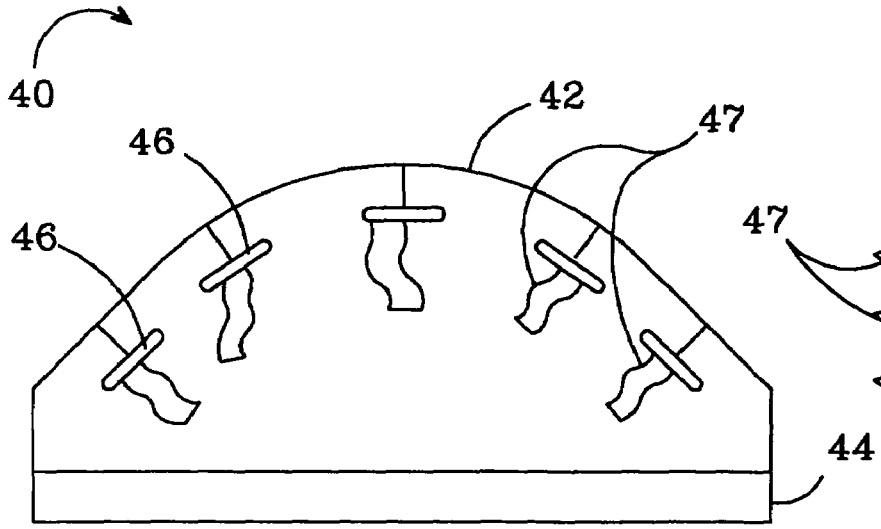
FIG. 3 shows a front elevation view of one embodiment of a radius tool according to the present invention, used in bending the perimeter lighting.
Figure 4:
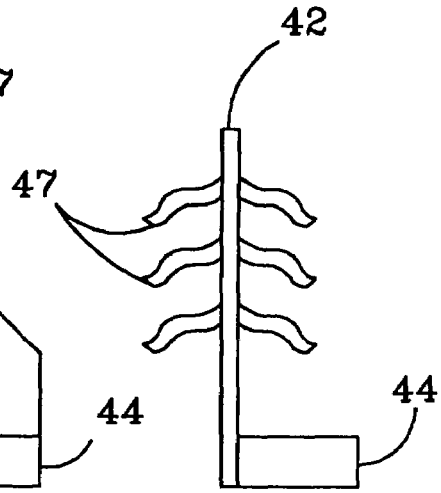
FIG. 4 shows a side elevation view of the radius tool shown in FIG. 3.

In step 16 a radius tool is provided that includes a curved surface with a shape and radius that matches the shape and radius of a curved feature, such as a building's curved architectural feature. Many different radius tools can be used according to the invention. FIGS. 3 and 4 show one embodiment of a radius tool 40 according to the present invention that can be provided in step 16. The radius tool has a single curved section 42 which matches the curved architectural feature and matches the desired curve for the bent perimeter lighting. The radius tool 40 can comprise many different shapes and can provide many different curves. The tool 40 can also comprise a horizontal base 44 that holds the curved section in a vertical orientation. The tool also comprises a means for mounting the perimeter light longitudinally along the curved section 42. FIG. 3 shows one mounting means according to the present invention that comprises slots 46 along the edge of the curved section 42 and respective straps 47 arranged within each of the slots 46. The slots 46 are approximately 1.5 inches from the edge, although they can be located in many different locations according to the present invention. The tool 42 can be made of many different rigid materials that can withstand heating cycles, such as in an environmental chamber, with suitable materials including wood or metal.

In step 18, the heated perimeter light 30 is mounted to the curved section of the radius tool. In the embodiment where the perimeter light is heated in an environmental chamber, the light is removed from the chamber and as soon as possible is mounted to the radius tool. When using the radius tool 40 the perimeter light should be bent longitudinally along the tool's curved section 42. This can be done by one person holding the light 30 against the curved section while another person closes the straps 47 tightly over the light 10. The straps 47 can be held closed around the perimeter lighting using many different mechanisms including but not limited to hooks, snaps, buttons or zippers, with the preferred mechanism being hook and loop mechanism commonly known as Velcro. When the straps 47 are closed the perimeter light is held against the tool's curved section 42 by the straps 47.

Depending on the complexity of the curved section of a radius tool, the perimeter light 30 can be bent in many different shapes and in many different planes. For a simple radial bent light the tube is bent along the vertical plane, so the bottom surface of the tube 32 is held against the edge of the curved section 42 during bending. For a flat bent light the tube is bent along the horizontal plane so one of the side surfaces of the tube is held against the edge of he curved section during bending, depending on the desired direction of curvature.

If the perimeter light 30 were now allowed to cool and is removed from the curved section 42 after cooling, there is a danger that the perimeter light would not hold the curve, but would instead partially or fully "spring back" to its straightened condition. To reduce this danger, in step 20 the perimeter light 30 is heated a second time while it is strapped to the curved section with the heating time being sufficient to relieve the stresses that exist in the tube material from the initial bending to the curved surface. By relieving these stresses, the bend in the tube 32 takes better hold and spring back is reduced or eliminated. The tube 32 can be reheated using many different methods, with a preferred method being placing the tool 40 with the perimeter light 30 in an environmental chamber similar to the one used in step 14 above. The perimeter light soaks for the desired amount of time and for an acrylic tube being approximately 0.85 inches thick and using an environmental chamber at 95° C., a suitable soak time is approximately 10 minutes.

In step 22 the perimeter light is cooled, with a preferred cooling method being removing the perimeter light 30 and radius tool 40 combination from the environmental chamber and directing a standard fan on the perimeter light 30 for approximately 10 minutes. In step 24, the perimeter light 30 is then removed from the tool 40 by opening straps 47. The bent perimeter light should substantially retain the bend that matches the shape and radius of the curved section 42.

Bent Perimeter Light

Figure 5B:
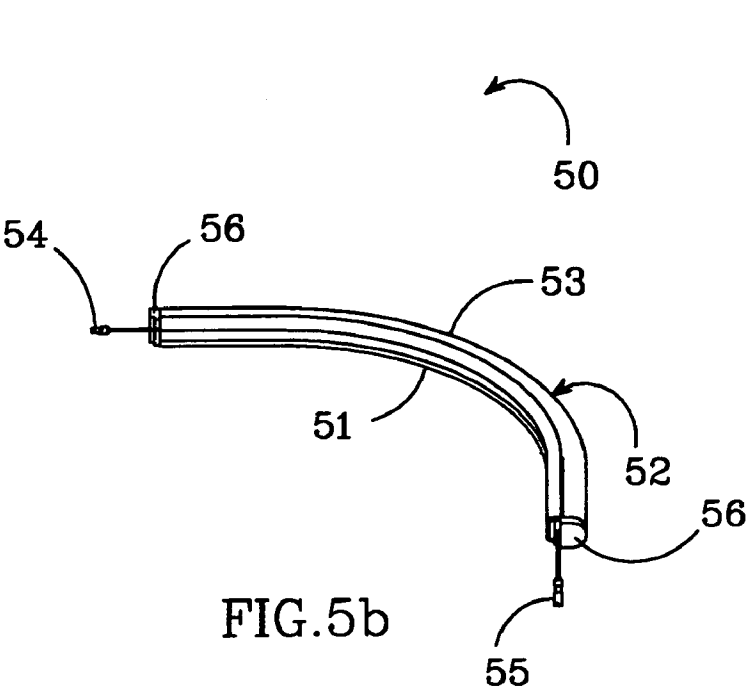
FIGS. 5*a*, 5*b* and 5*c* show perspective views of one embodiment of a radial bent perimeter light according to the present invention.
Figure 5A:
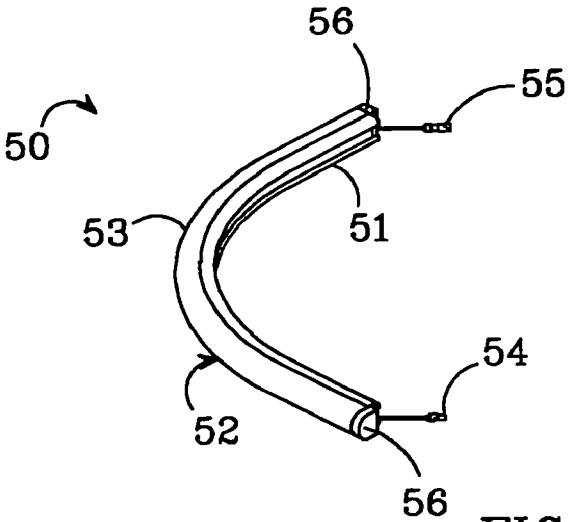
Figure 5C:
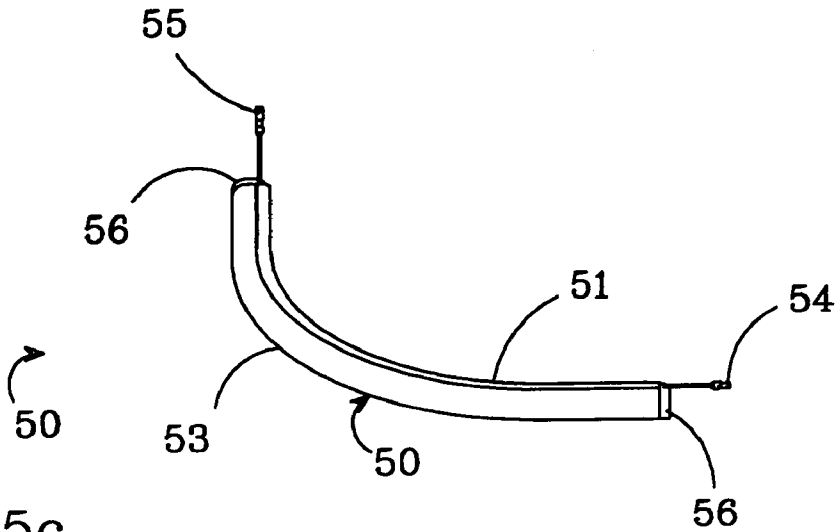

FIGS. 5*a*, 5*b*, and 5*c* show different views of a bent perimeter light 50 according to the present invention. The bent light 50 has a radial bend along the light's vertical plane, i.e. along the plane that passes through the top and bottom of the tube light. This results in the inside surface of the bend being the light's bottom surface or track 51. The light could also be bent in the opposite direction such that the top of the light is the inside surface of the bend.

Figure 6B:
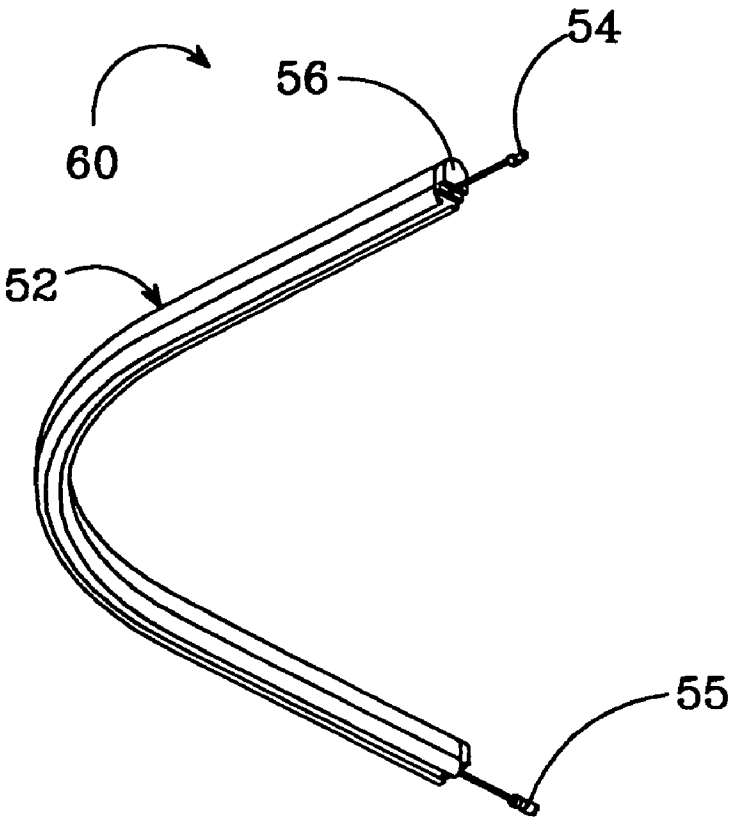
FIGS. 6*a*, and 6*b* show perspective views of one embodiment of a flat bent perimeter light according to the present invention.
Figure 6A:
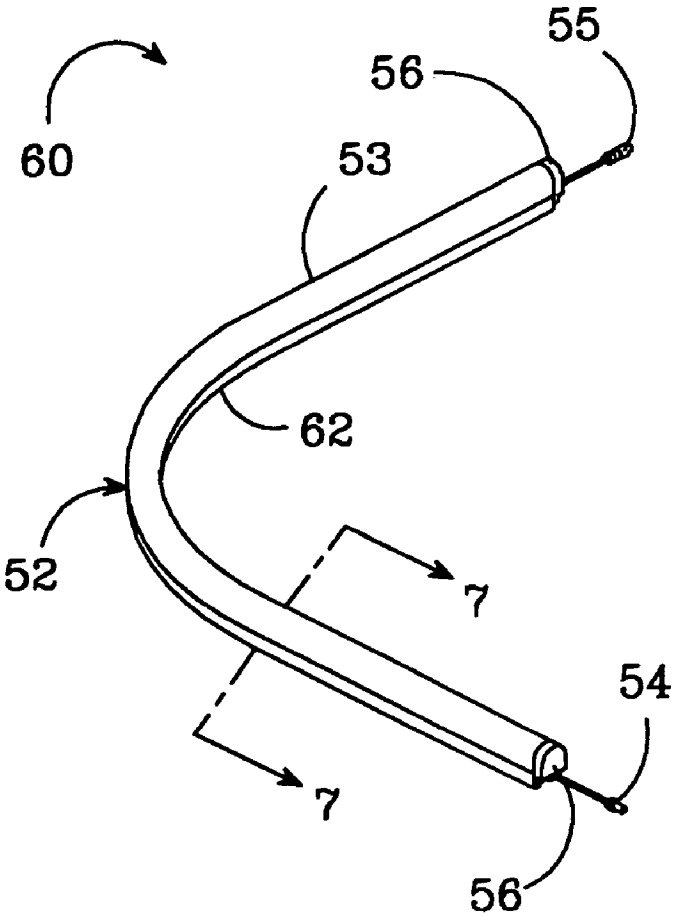

FIGS. 6*a* and 6*b* show views of a flat bent perimeter light 60 having a flat bend along the lights horizontal plane, i.e. along the plane that passes through the side surfaces of the light. Light 60 is bent such that one of its side surfaces is the inside surface of the bend. Light 60 can also be bent in the opposite direction of curvature such that opposite side surfaces is the inside surface of the bend.

The perimeter lights 50 and 60 have similar features and the same reference numerals will be used in each of FIGS. 5*a*–5*c*, 6*a* and 6*b* in describing perimeter lights 50 and 60. Each includes an elongated tube 52 that has a substantially oval shaped cross-section, and houses LEDs arranged within the tube so that a bias can be applied to them to cause them to emit light substantially through the top 53 of the tube 52. It should be understood that the LEDs can be mounted in many orientations using many different mounting methods. It should also be understood that many different numbers of LEDs can be used that emit the same or different luminous flux and/or the same or different wavelengths of light.

The tube 52 can be made of many different light transmitting materials, but is preferably made of a material that is light transmitting, as well as impact resistant and UV stable, which helps the light withstand the environmental conditions when used outside. One of the preferred materials for the tube 52 is acrylic, which is relatively rugged and UV stable and can be provided in many different colors. To provide the maximum light emission from the LEDs, the tube 52 should have filter characteristics that transmit primarily the wavelength of light emitted from the LEDs, while having the opacity to diffuse but not over-attenuate the emitting light.

The perimeter lights 50 and 60 can also comprise male and female connectors 54, 55 with a male connector 54 extending out one end of the tube 52 and the female connector 55 extending out the opposite end. This allows the lights to be connected in a daisy chain with other straight or bent perimeter lights, with power from the lights being transmitted from light to light through the male and female connectors in the daisy chain.

The perimeter lights 50 and 60 can also comprise end bumpers 56 (end caps) that keep water and dirt out of the interior of the tube 52 and are also arranged to compensate for expansion and contraction between adjacent lights. One or more perimeter lights can be connected in a daisy chain with the ends of the lights abutting the end of the adjacent light, with the bumpers 56 between the ends of the lights. The tube 52 and internal component of each light can expand and contract from the heat of the LEDs or from the ambient temperature, and the different materials comprising the tube 52 and the internal components can expand and contract at different rates. For instance, the LEDs can be arranged on a PCB that can expand more than the tube 52 for a given temperature, which can result in the PCB extending from the end of the tube 52. The bumpers 56 compensates for this expansion while not being forced from the end of the tube 52. The bumpers also compensate for the expansion of adjacent tubes by being compressible. The preferred bumper 56 is made of a flexible and durable material such as silicone, although other materials can also be used.

Figure 7:
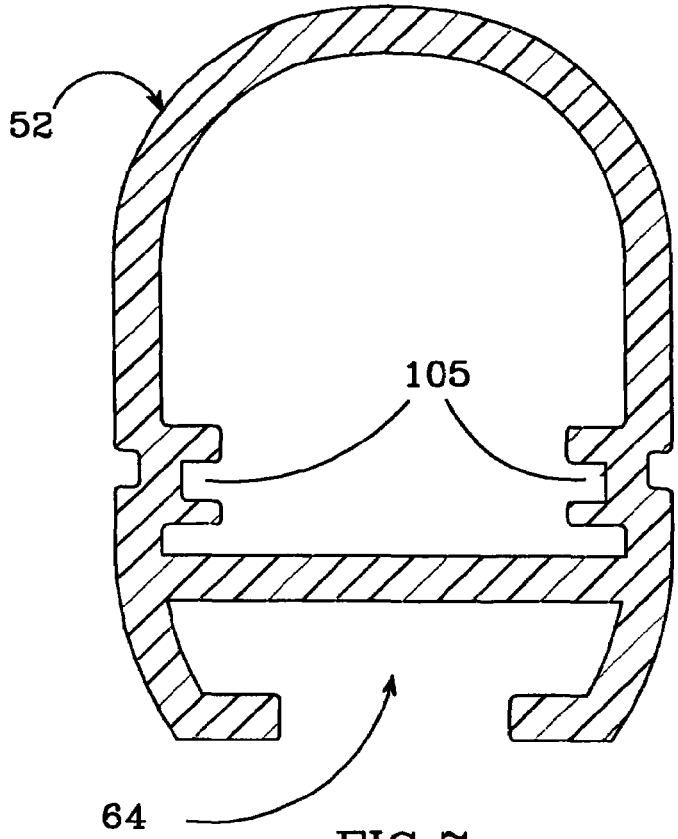
FIG. 7 shows a sectional view of the perimeter light tube taken along section lines 7—7 in FIG. 6*a;*
Figure 8:
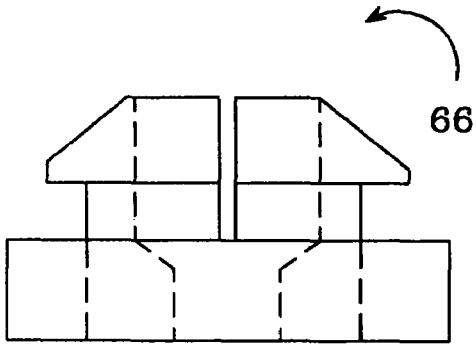
FIG. 8 shows an elevation view of one embodiment of a mounting button according to the present invention.
Figure 9:
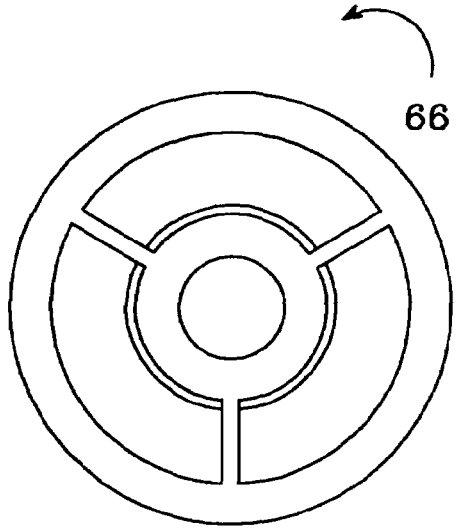
FIG. 9 shows a plan view of the mounting button shown in FIG. 8.
Figure 12:
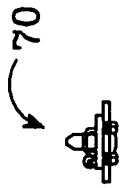
FIG. 12 is an end view of the PCB LED linear array shown in FIG. 10.

The perimeter lights can be mounted to a structural feature using many different mounting methods, with a preferred method being mounting buttons. Referring to FIG. 7, the tube 52 has a bottom tube track 64 running longitudinally down its entire length. FIGS. 8 and 9 show mounting buttons 66 that that are sized to mate with the tube track 64. The buttons 66 are mounted to a structure along a line at the location where the bent light is to be held, with a preferred mounting method being screws. The track 64 then snaps over the buttons 66 to hold the perimeter light to the structure at the curved feature. Alternatively, the perimeter light can slide onto the buttons.

As described above, LEDs can be arranged within the tubes in many different orientations using many different mounting methods. FIGS. 10–13 show one embodiment of apparatus according to the present invention for mounting the LEDs in an array using a segmented printed circuit board (PCB) LED array 70 that is disposed within the tube 52. The LED array 70 is particularly adapted for use in flat bend perimeter lights, although the LED array 70 can also be used in radial bend perimeter lights.

The LED array 70 can be arranged in many different ways according to the present invention but as shown comprises serially connected PCBs 72, with each PCB having LEDs 73 and passive components such as a resistor 74 and a capacitor 75 mounted to it. Each POB also comprises conductive traces that interconnect the LEDs 73, resistor 74 and capacitor 75. Wires 76 and 77 run between each of the adjacent POBs and are used to apply a bias to one end of each PCB 72 and to conduct the bias to the next serially connected PCB at the other end of the PCB 72.

Figure 14:
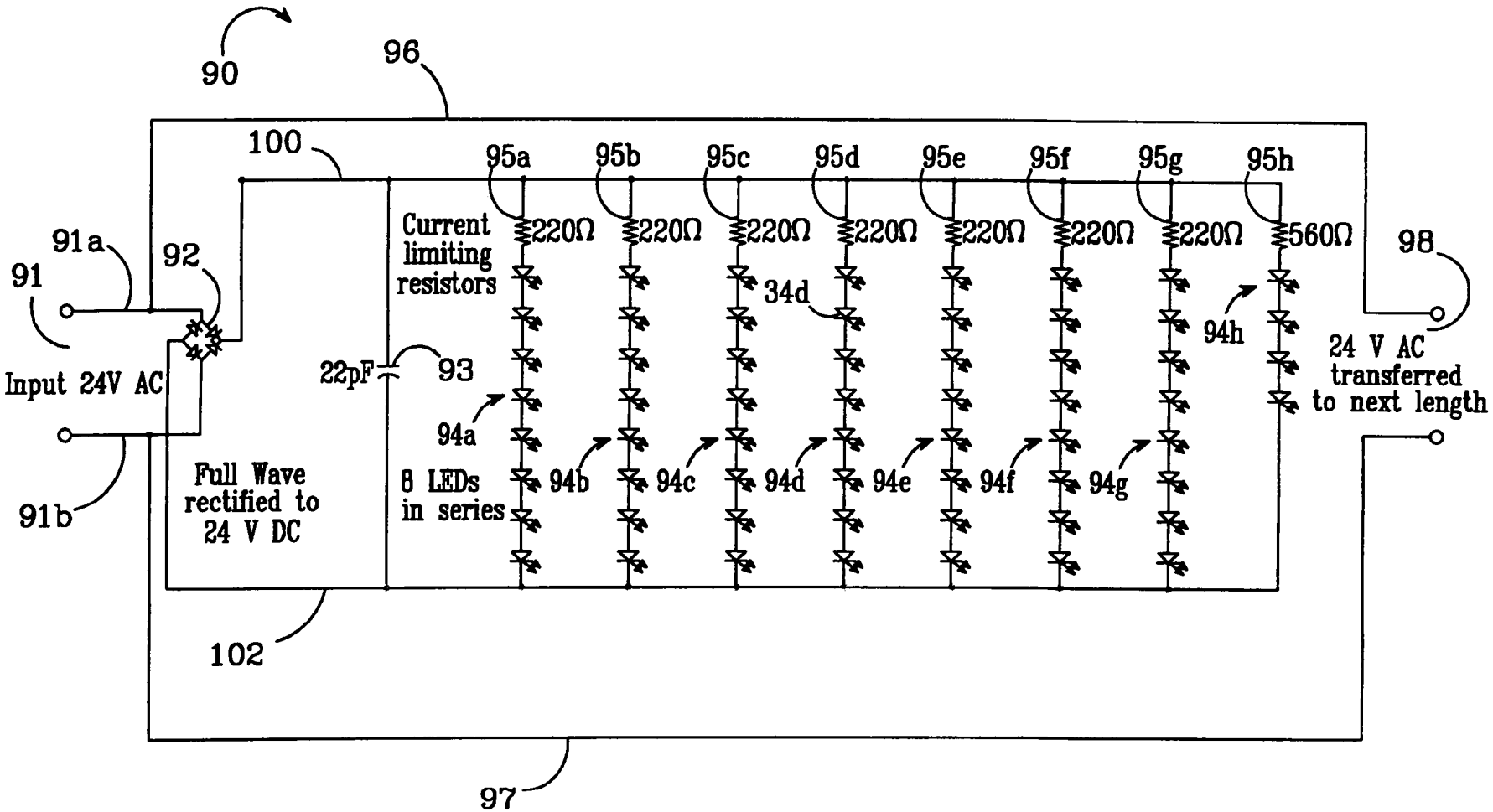
FIG. 14 is a schematic of the electronic components on the PCB linear array of FIGS. 10–13 and their interconnections.

One advantage of the lights 50 and 60 is that they can be cut at different lengths to match the length of a particular structural feature and the perimeter light tube can also be cut. Different lengths of bent lights do not need to be special ordered but can be cut in the field. FIG. 14 shows a schematic 90 of one embodiment of a PCB LED array 90 according to the present invention showing its electronic components and their interconnections, and how these interconnections allow the LED array to be cut in the field. A power supply 91 provides power to the LED array 90. The array 90 can operate using many different power supplies that provide different voltages, including alternating current (AC) or direct current (DC), with a preferred power supply providing 24 volt (V) AC power. In another embodiment a step down transformer (not shown) can be used to reduce the a typical 120V AC power to the desired 24V AC power. The 24V AC power can be connected to LED array 90 along two conductive wires 91*a* and 91*b* with suitable wires being 20 AWG that are known in the art. The 24V AC power is then applied to a diode bridge rectifier 92, which full wave rectifies the AC signal. A capacitor 93 can be included to smooth the rectified signal to provide an approximate 24V DC power. The DC power is then applied to a first sub-array of eight (8) LEDs 94*a* along first and second DC conductors 100 and 102, with the LEDs in the sub-array 94*a* in series with a current limiting resister 95*a*. The sub-array of LEDs 94*a* with the resistor 95*a* are included on a respective one of the serially connected PCBs in the PCD LED array 90.

The PCB LED array 90 comprises additional parallel LED sub-arrays 94*b–h*, with each having the same or a different number of LEDs as array 94*a*. Each of the sub-arrays 94*b–h* is included on a separate PCB and the LEDs on each sub-array 94*b–h* are arranged in parallel to the LEDs on the first sub-array 94*a*. The DC power applied across each of the sub-arrays 94*a–h* along conductors 100 and 102, and each of the sub-arrays 94*a–h* has a respective current limiting resistor 95*a–h*.

The LED array 90 transfers the 24V AC power from the one end of the array to the other along first and second AC conductors 96 and 97, which are connected to an LED array output 98. The conductors 96 and 97 carry the 24V AC power from the array input 91 to the array output 98. The AC power can then be transferred to the next perimeter light in the array through the mated male and female connectors (described above) that connect adjacent perimeter lights in a perimeter light daisy-chain. A conventional step down transformer (not shown) can provide a 24V AC power supply to power up to 100 feet of daisy chained perimeter lights. Other transformers can power greater lengths of lights and the use of different electronic components can increase or decrease the length of lighting that can be powered.

Figure 10:
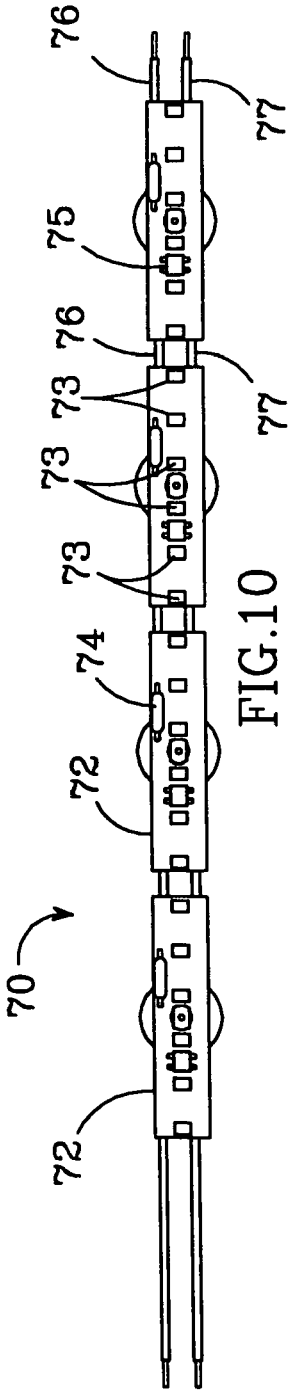
FIG. 10 shows a plan view of one embodiment of a PCB LED linear array according to the present invention.
Figure 11:
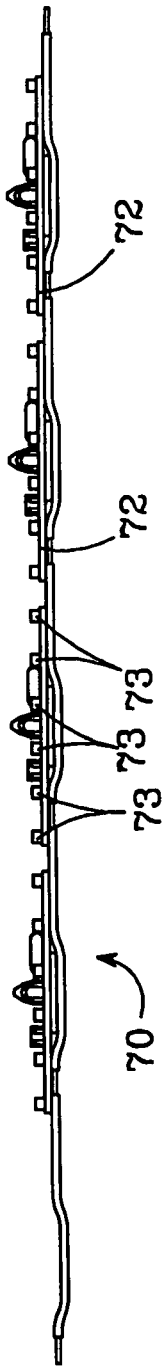
FIG. 11 is an elevation view of the PCB LED linear array shown in FIG. 10.
Figure 13:
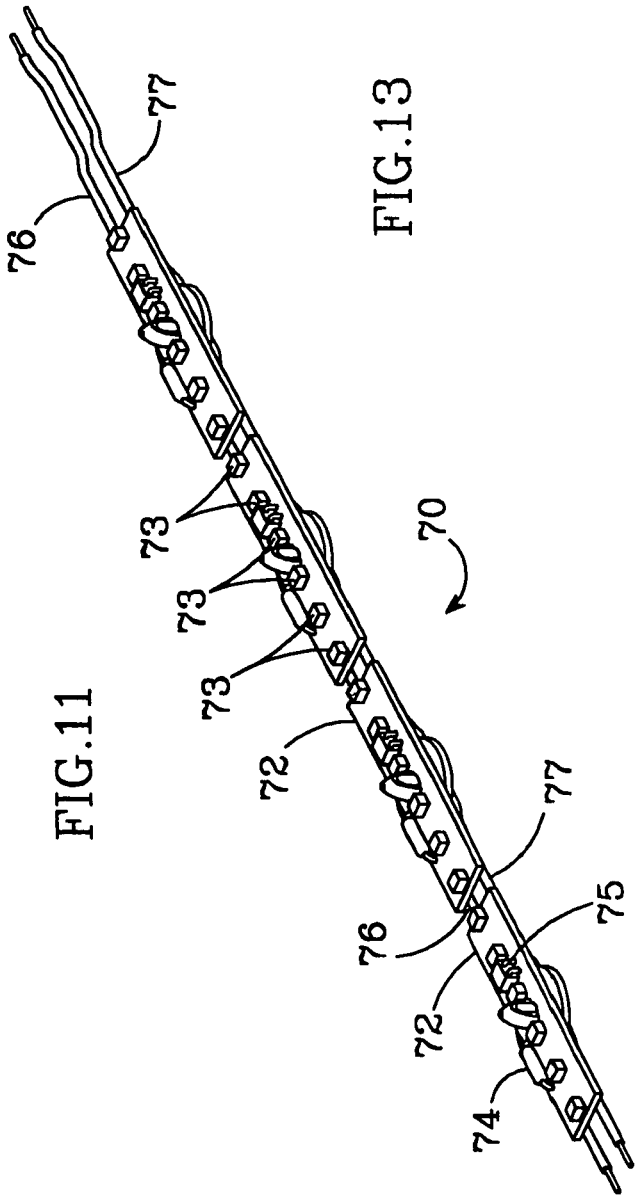
FIG. 13 is a perspective view of the PCB LED linear array shown in FIG. 10.

The DC conductors 100 and 102 run between each of the PCBs in the LED array 90 and conductor DC power from the bridge rectifier 92 and the sub-arrays 94*a–*94*h*. The conductors 100 and 102 are shown in FIGS. 10 and 13 as wires 76 and 77 in FIGS. 7–10. The conductors 97 and 98 pass through the LED array 90, independent of the power applied to the sub-arrays 94*a–h* through conductors 100 and 102. As a result, one or more of the sub-arrays 94*a–g* can be cut-away from the array 90 by cutting through conductors 100 and 102, without cutting the conductors 97, 98. One of the intermediate perimeter lights can be cut to match a structural feature while still allowing the light to be daisy-chained with additional lights. For instance, sub-arrays 95*e–*95*h* can be cut away from the LED array 90 by cutting conductors 100 and 102 between the PCBs that contain sub-array 95*d* and 95*e*. The tube is then shortened by cutting away a length to match the length of the PCBs holding sub-arrays 95*e–*95*h*.

The conductors 97 and 98 can remain uncut when the sub-arrays are cut to shorten the LED array, which allows conductors 97 and 98 to be connected to the next perimeter light. This provides the ability to custom cut the perimeter lights in the field to match various structural features while still allowing the cut light to be connected in a daisy chain. Different lengths of perimeter lights do not need to be special ordered to match the length of the structural feature, which reduces the cost, time and inconvenience involved in installing perimeter lights.

Figure 15:
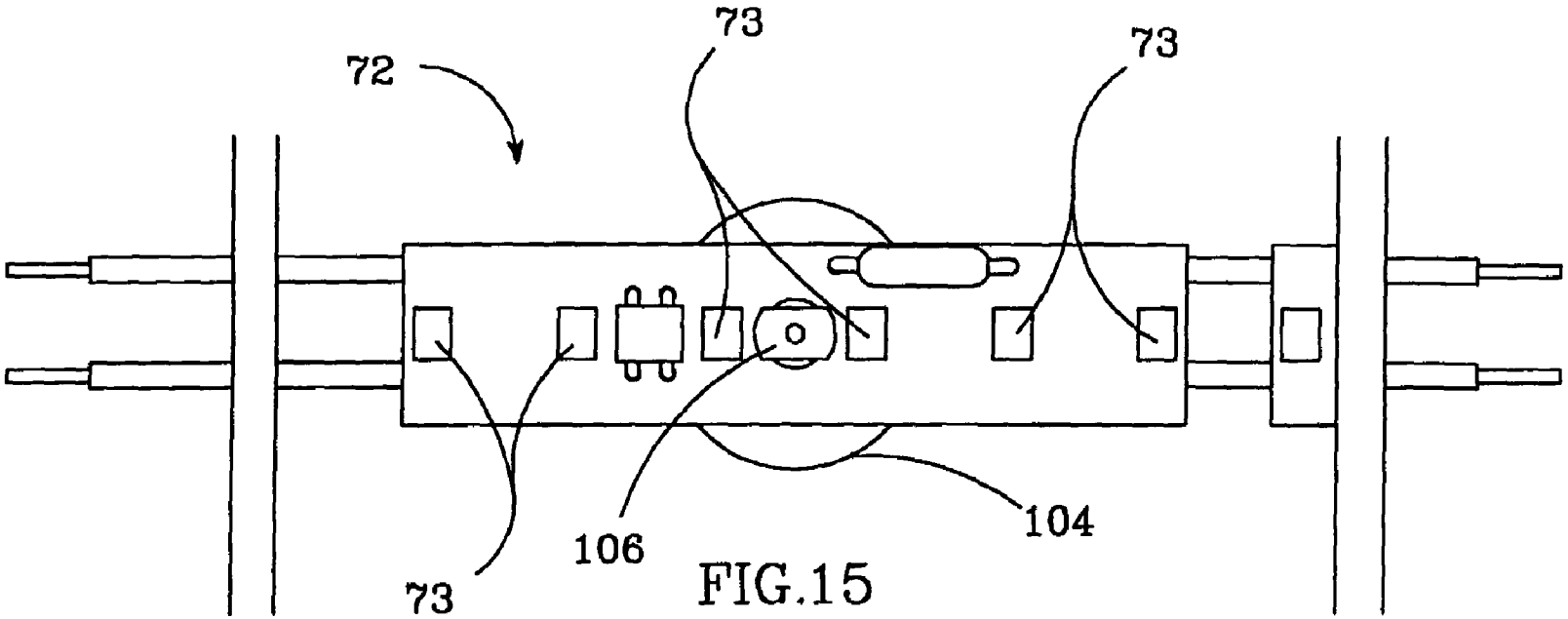
FIG. 15 is an enlarged plan view of one of the PCBs in the PCB LED linear array in FIG. 10.
Figure 16:
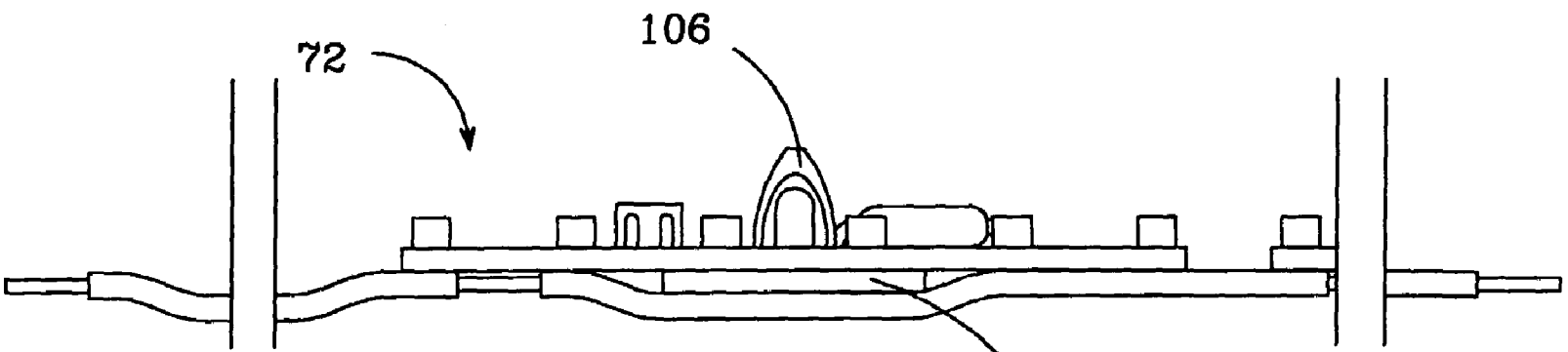
FIG. 16 is an elevation view of the PCB in FIG. 15.

FIGS. 15 and 16 show enlarged views of one of the PCBs 72 that is mounted in an array, each of which can comprise LEDs 73, resistor 74 and capacitor 75. Each also has a bottom mounted washer 104 that slides onto a slot 105, shown in FIG. 7, within the tube 52. The slot 105 is arranged such that the PCBs 72 are held in a substantially horizontal orientation with light from the LEDs 73 directed up. The washer 104 can be mounted to its respective PCB by many different methods, with a preferred method being an arrow rivet 106 passing through a hole in the PCB 72. First and second DC conductors 100 and 102 carrying the DC power between the PCBs 72 in the LED array and pass under each PCB 72 and over its respective washer 104.

By providing the LED array as a series of PCBs 72 with washers 104 (instead of one long PCB) LED array can be more easily bent to match the bend in the tube 42, particularly for flat bend perimeter lights. The bend in the tubes of lights 50 and 60 in FIGS. 5*a–*5*c*, 6*a* and 6*b* is compensated for by the spaces between adjacent PCBs 72 so that the PCBs themselves do not experience excessive bending. For flat bent lights 60, the space between adjacent PCBs 72 should be sufficient so that the light can bend to a radius without the PCBs contacting or interfering with adjacent PCBs. In one embodiment of the PCB LED array according to the present invention the space between adjacent PCBs 72 is approximately ¼ inch, which allows for a 6-inch radius flat bend in the light 60. This separation between the PCBs 72 also keeps the distance between the end LEDs in adjacent PCBs 72 approximately the same as the distance between the LEDs on the PCBs 72 so that light emitting from the perimeter light appears substantially uniform.

In other embodiments of the LED array according to the present invention, the sub-arrays can be mounted to a flexible circuit board material with the DC conductors being traces on the circuit board. One such flexible circuit board material is known in the art as Kapton® flex circuit provided by Dupont, Inc. The resulting LED array circuit would contain similar electronics to the LED arrays described above but instead of being cuttable between PCBs, the tube of the light would contain markings at the locations where a cut through the tube would also result in a cut between LED sub-arrays. This type of flexible circuit could be mounted within the tube in many different ways and in many different orientations. Each of the LED arrays could also include voltage or current control devices at each of the sub-arrays, such as a LM317L 3-Terminal Adjustor Regulator provided by National Semiconductor Corporation. The devices could compensate for potential voltage drops along the sub-arrays by providing a more uniform current or voltage at each of the sub-arrays. The perimeter light could then emit a more uniform intensity of light along its length.

Although the present invention has been described in considerable detail with reference to certain preferred configurations thereof, other versions are possible. Many different steps can be used in methods according to the present invention and the steps can be taken in a different order. Other materials and devices can be used in perimeter lights according to the present invention. Therefore, the spirit and scope of the invention should not be limited to the preferred versions described above.

We claim:

1. A method for bending a solid state perimeter light, comprising:

heating a solid state perimeter light a first time to make it pliable, wherein said perimeter light is heated uniformly across the entire length of said perimeter light;

providing a radius tool having a curved surface with a shape and radius for the desired bend in said solid state perimeter light;

mounting said heated solid state perimeter light to said radius tool curved surface;

cooling said solid state perimeter light; and removing said solid state perimeter light from said radius tool.

2. The method of claim 1, further comprising the step of heating said solid state perimeter light a second time after it has been mounted to said curved surface of said radius tool.

3. The method of claim 1, wherein said step of heating said solid state perimeter light a first time comprises placing said solid state perimeter light in a heated environmental chamber.

4. The method of claim 2, wherein said step of heating said solid state perimeter light a second time comprises placing said solid state perimeter light in a heated environmental chamber.

5. The method of claim 1, wherein said solid state perimeter light is bent to match the curves in a structural feature, said radius tool curved surface having a shape to match the curves in the structural feature.

6. The method of claim 1, where said step of mounting said heated solid state perimeter light to said radius tool curved surface comprises strapping said solid state perimeter light to said curved surface.

7. The method of claim 1, wherein said step of cooling said solid state perimeter light comprises allowing said solid state perimeter light to cool at room temperature.

8. The method of claim 1, wherein said step of cooling said solid state perimeter light comprises blowing air over said solid state perimeter light.

9. The method of claim 1, wherein said solid state perimeter light comprises an acrylic tube.

10. The method of claim 1, wherein said step of heating said solid state perimeter light a first time comprises placing said solid state perimeter light in an environmental chamber at 95° C. for 10 minutes.

11. The method of claim 2, wherein said step of heating said solid state perimeter light a second time comprises placing said solid state perimeter light and radius tool in an environmental chamber at 95° C. for 10 minutes.

12. A system for bending a solid state perimeter light, comprising:

a heater for uniformly heating a solid state perimeter light across the entire length of said perimeter light to make it pliable; and a radius tool having a curved surface and a mechanism for holding the heated solid state perimeter light to the curved surface while it cools.

13. The system of claim 12, wherein said heater for heating a solid state perimeter light comprises an environmental chamber.

14. The system of claim 12, wherein said holding mechanism comprises straps integral to said radius tool and closable around said solid state perimeter light, holding it to the curved surface.

15. The system of claim 12, further comprising a heater to heat said solid state perimeter light a second time while being held to said curved surface.

16. A method for shaping a solid state perimeter light, comprising:

providing at least one solid state lighting emitter for disposal within an optical housing;

heat soaking said optical housing a first time to make it pliable;

removing the optical housing from said heat soaking;

shaping said optical housing with a radius tool having a curved surface corresponding to the desired shape;

mounting said heated optical housing to said radius tool curved surface;

cooling said optical housing; and removing said optical housing from said radius tool.

17. The method of claim 16, wherein said solid state emitters are disposed within said optical housing prior to heat soaking said optical housing.

18. The method of claim 16, further comprising:

inserting light emitting elements into said optical housing after heat soaking and cooling said optical housing.

* * * * *